US007195331B2

(12) United States Patent
Colombat et al.

(10) Patent No.: US 7,195,331 B2
(45) Date of Patent: Mar. 27, 2007

(54) HYDROELECTRIC COUPLING FOR A PRINTHEAD AND A PRINTER EQUIPPED WITH ONE SUCH COUPLING

(75) Inventors: Thierry Colombat, La Voulte S/Rhone (FR); Julien Cocagne, Valence (FR)

(73) Assignee: Imaje S.A., Bourg les Valence Cedex (FR)

( * ) Notice: Subject to any disclaimer, the term of this patent is extended or adjusted under 35 U.S.C. 154(b) by 261 days.

(21) Appl. No.: 10/508,348

(22) PCT Filed: Mar. 19, 2003

(86) PCT No.: PCT/FR03/00878

§ 371 (c)(1),
(2), (4) Date: Sep. 20, 2004

(87) PCT Pub. No.: WO03/080346

PCT Pub. Date: Oct. 2, 2003

(65) Prior Publication Data

US 2005/0110836 A1 May 26, 2005

(30) Foreign Application Priority Data

Mar. 22, 2002 (FR) ..... 02 03605

(51) Int. Cl.
*B41J 2/015* (2006.01)
*B41J 2/02* (2006.01)
*B41J 2/175* (2006.01)

(52) U.S. Cl. ..... 347/20; 347/73; 347/87

(58) Field of Classification Search ..... 348/20, 348/50, 58, 63, 65, 86, 87, 73
See application file for complete search history.

(56) References Cited

U.S. PATENT DOCUMENTS 3,929,071 A * 12/1975 Cialone et al. ..... 101/335

(Continued)

FOREIGN PATENT DOCUMENTS

EP 0 764 538 A 3/1997

(Continued)

OTHER PUBLICATIONS

Patent Abstracts of Japan, vol. 1998, No. 09, Jul. 31, 1998 & JP 10 086385 A, Apr. 7, 1998.

*Primary Examiner*—Anh T. N. Vo
(74) *Attorney, Agent, or Firm*—Pearne & Gordon LLP

(57) ABSTRACT

An ink jet printer is characterised in that a connection part (1) of an umbilical connected to a connection part of a print head of the printer, comprises:

first (12, 13, 14, 15, 17, 18, 20–23, 25) and second means (12, 14, 15, 16, 25) for positioning the umbilical electrical terminations (13, 19) and hydraulic terminations (24) mechanically fixed to the connection part (1) of the umbilical;

third (12, 28) positioning means mechanically connected to the umbilical, and fourth positioning means (31, 48) mechanically connected to the connection part (3) of the print head, the third (12, 28) positioning means and the fourth positioning means (31, 48) cooperating to position the connection part (1) of the umbilical with respect to the connection part (3) of the print head.

A translation movement alone is necessary to connect the umbilical onto the print head.

18 Claims, 3 Drawing Sheets

U.S. PATENT DOCUMENTS

| | | | | |
|---|---|---|---|---|
| 3,965,376 | A * | 6/1976 | Arndt | 310/326 |
| 4,074,284 | A | 2/1978 | Dexter et al. | |
| 4,338,613 | A | 7/1982 | Cruz-Uribe | |
| 4,339,763 | A * | 7/1982 | Kyser et al. | 347/71 |
| 4,586,058 | A * | 4/1986 | Yamazaki et al. | 347/92 |
| 4,959,667 | A * | 9/1990 | Kaplinsky | 347/87 |
| 5,623,292 | A | 4/1997 | Shrivastava et al. | |
| 5,847,734 | A * | 12/1998 | Pawlowski, Jr. | 347/86 |
| 5,969,738 | A * | 10/1999 | Tomikawa et al. | 347/86 |

FOREIGN PATENT DOCUMENTS

| | | |
|---|---|---|
| EP | 0 778 142 A | 6/1997 |
| EP | 0 805 035 A | 11/1997 |
| EP | 0 885 730 A | 12/1998 |

* cited by examiner

HYDROELECTRIC COUPLING FOR A PRINTHEAD AND A PRINTER EQUIPPED WITH ONE SUCH COUPLING

TECHNICAL DOMAIN

The domain of the present invention is electrical fittings between electrical signal sources and a print head of a printer, particularly an ink jet printer. It also relates to hydraulic fittings between different fluid management reservoirs and the said printer print head. It relates to a part of the fitting located at the print head, part of these fittings connected to the said electrical signal sources and the reservoir, and finally electrical and hydraulic fittings as a whole. It also relates to an ink jet printer equipped with the said fittings.

TECHNOLOGICAL BACKGROUND

The typical operation of a continuous jet printer may be described as follows. Electrically conducting ink held under pressure in a pressurized chamber of a print head escapes from a calibrated nozzle, thus forming an ink jet. Under the action of a periodic stimulation device, the ink jet thus formed is interrupted at a single point in space at regular time intervals. This forced fragmentation of the ink jet is usually induced at a point called the breaking point of the jet by periodic vibrations of a piezoelectric crystal placed in the ink contained in the pressurized chamber on the upstream side of the nozzle. Starting from the break point, the continuous jet is transformed into a stream of identical ink drops at a regular spacing. A first group of electrodes called "charge electrodes" is placed close to the break point, the function of which is to selectively transfer a predetermined quantity of electrical charge, for each drop in the stream of drops. All drops in the jet then pass through a second arrangement of electrodes called the "deflection electrodes" forming an electrical field that will modify the path of the charged drops.

In a first variant embodiment of so-called continuous deviated inkjet printers, the quantity of charge transferred to the drops in the jet is variable and each drop is deflected by an amount proportional to the electrical charge that was previously assigned to it. The point on the print support at which a drop lands depends on this electrical charge. Non-deflected drops are recovered by a gutter forming part of the print head and are recycled towards an ink circuit.

One known embodiment of a continuous deviated jet printer is illustrated in FIG. 1.

A printer comprises a reservoir 111 containing electrically conducting ink 110 that is distributed through a distribution channel 113 to a drops generator 116. The drops generator 116 forms an ink jet from the pressurized ink contained in the distribution channel 113, and breaks this jet into a stream of drops. These drops are selectively electrically charged using a charge electrode 120 powered by a voltage generator 121. The charged drops pass through a space between two deviation electrodes 102, 103. Their deviation varies depending on their charge. The least deviated drops, and undeviated drops, are directed towards an ink recovery container or a gutter 106, while other deviated drops are directed towards a substrate 127 locally supported by a support 213. The successive drops in a burst reaching the substrate 127 can thus be diverted to a low extreme position, a high extreme position and successive intermediate positions. All drops in the burst form a line with width $\Delta x$ perpendicular to a direction Y in which there is a relative forward movement of the print head and the substrate. The print head is formed by means 116 for generating the ink jet and separating it into drops, the charge electrode 120, the deviation electrodes 102, 103, and the gutter 106. This head is usually enclosed in a casing not shown. The time elapsed between the first and the last drop of a burst is very short. The result is that despite a continuous movement between the print head and the substrate, it may be considered that the substrate has not moved with respect to the print head during the time of a burst. The bursts are fired at regular intervals in space. The combination of the relative movement of the head and the substrate, and the selection of drops in each burst that are directed towards the substrate, provides a means of printing any pattern like that shown as 128 in FIG. 1.

In order to perform its function, it is clear that the print head of a printer must be connected hydraulically firstly to a pressurized reservoir, and secondly to a receptacle receiving back ink not directed to the substrate. In general, in addition to the ink supply and recovery connections, the print head comprises connections to an ink solvent reservoir and a compressed air inlet. Electrically, the head must be connected to voltage supply sources, signal sources, so as to receive voltages and information necessary for the electrical power supply for the drop formation means, for example a piezoelectric crystal, and charge and deviation electrodes. It should be noted that voltage necessary for the deviation electrodes may be of the order of several thousand volts. With such values, the electrical connection must be particularly well insulated.

For these purposes, a print head of a printer is provided with one or several electrical fittings and one or several hydraulic fittings. Each of these electrical and hydraulic fittings has to be connected during assembly or replacement of a print head.

It has been explained in patent application EP 0 805 035 A2 that the connection of an umbilical transporting data, fluids and the electrical power supply to the print head, has always been a complicated process involving welding with high precision machines when the umbilical is welded, or deformations and twisting of cables when the umbilical is screwed. It is practically impossible to disassemble the umbilical without causing damage.

Patent application EP 0 805 035 A2 describes a system shown in the figure of this EP application, for connecting an umbilical 1 and a structure 2 to support a print head that will simplify assembly and disassembly of the umbilical. A rigid cap 3 housing the print head is located between the support structure 2 of the print head and the umbilical 1. A threaded terminal part 7 of the umbilical may easily be screwed/unscrewed in a threaded opening 9 of the cap 3. When this is done, the cap 3 fitted with the umbilical is fitted onto the support 2 using the screws 5. A locknut 8 installed on the thread 7 between the umbilical and the cap 3 locks the assembly.

BRIEF DESCRIPTION OF THE INVENTION

The present invention is intended to simplify assembly and replacement of print heads, and to achieve this, to provide a terminal part of the umbilical with first means for positioning electrical terminal parts and second means for positioning hydraulic terminal parts, mechanically fixed to the terminal part of the umbilical. Finally, third means mechanically fixed to the umbilical are used to position the umbilical with respect to a connection part of the print head.

The connection part of the print head is provided with fourth positioning means cooperating with the third means for positioning the umbilical such that during connection of the umbilical to the connecting part of the print head, the terminal hydraulic parts of the umbilical connect to the terminal hydraulic parts of the print head, and the terminal electrical parts of the umbilical connect to the terminal electrical parts of the print head.

Thus, firstly the umbilical has a terminal part fitted with means for positioning electrical and hydraulic terminal parts mechanically fixed to the terminal part of the umbilical, and secondly the print head is provided with a connection part.

During an assembly, all that is necessary is to push the terminal part of the umbilical towards the connection part of the print head, to make the connection. When the connection has thus been made, attachment means distributed partly on the umbilical and partly on the connection part of the print head, hold the umbilical in position with respect to the print head.

In summary, the invention relates to an ink jet printer comprising a print head with a connection part to connect the electrical and hydraulic terminal parts of the print head to an umbilical connected to the printer hydraulic circuits and electrical conductors, the umbilical being provided with a terminal connection part formed by hydraulic pipe terminations and electrical conductor terminations, characterised in that the connection part of the umbilical comprises:

- first positioning means, mechanically connected to the connection part of the umbilical to position the electrical terminations in the connection part of the umbilical;
- second positioning means, mechanically connected to the connection part of the umbilical to position the hydraulic terminations in the connection part of the umbilical;
- third positioning means mechanically connected to the umbilical, and in that the connection part of the print head is provided with:

- a fixed connector of a body of the print head, this fixed connector being formed by hydraulic pipe terminations from a body of the print head for which one opening is at a determined position on the fixed connector, and electrical conductor terminations positioned mechanically with respect to the fixed connector;
- fourth positioning means mechanically connected to the connection part of the print head;

and in that in a position in which the umbilical and the print head are connected,

- the third and fourth connection means cooperate to position the connection part of the umbilical with respect to the connection means of the print head, electrical terminations of the umbilical positioned in the connection part of the umbilical by first positioning means being in the said connected position of the umbilical and the print head in contact with terminations of electrical conductors mechanically positioned with respect to the fixed connector, and hydraulic terminations of the umbilical positioned by the second positioning means of the umbilical being located in line with the hydraulic terminations of the fixed connector, a leak tight communication being set up between the hydraulic terminations of the umbilical and the hydraulic terminations of the pipes from the print head body thus formed.

Because the first, second, and third positionning means are mechanically connected to the umbilical, these means and the electrical and hydraulic terminations that they position are connected to or disconnected from the connection part of the body of the print head at the same time as the umbilical. There is no intermediate positioning part to be installed or removed when replacing a print head.

The invention also relates to a print head of an ink jet printer according to one of the various embodiments of the invention, with a connection part on the print head to connect electrical and hydraulic terminal parts of the print head to an umbilical making connections to the printer hydraulic circuits and electrical conductors, characterised in that, the connection part of the print head is fitted with:

- a fixed connector of a print head body, this fixed connector combining terminations of hydraulic pipes from a print head body, with an opening at a determined position on the fixed connector, and terminations of electrical conductors mechanically positioned with respect to the fixed connector;
- fourth positioning means mechanically connected to the said connection part of the print head, these fourth positioning means being designed to cooperate with third means of positioning the umbilical, cooperation between the third and fourth positioning means simultaneously positioning the hydraulic pipe terminations and the electrical conductor terminations of the print head fixed connector with respect to electrical conductor terminations and hydraulic pipe terminations located on the connection umbilical.

In the preferred embodiment of the invention, the high voltage of several thousand volts necessary particularly for ink drop deflection electrodes, is made from a low voltage source by electrical circuits housed inside a casing of the print head. The result is that insulation problems related to the umbilical connection are very much simplified.

According to one advantageous variant of the preferred embodiment, the shape of the deflection electrodes is such that a small and approximately constant inter-electrode spacing can be maintained throughout the length of the drops path. Thus, the deflection performances are obtained with a voltage significantly lower than the usual equipotential power supply voltages used for the deflection electrodes. The result is that electrical insulation problems are further reduced, while integration of the high voltage power supply in the print head is simplified.

BRIEF DESCRIPTION OF THE DRAWINGS

An example embodiment of the invention and variants of it, including a presentation of how the system functions and its characteristics, are described below, with reference to the attached drawings in which.

Part A shows a side perspective view of a set of two electrodes according to the variant embodiment of the invention. Part B shows a sectional view through two electrodes along line A—A of part A. Part C shows a perspective view of a split electrode according to the variant embodiment of the invention.

DESCRIPTION OF AN EXAMPLE EMBODIMENT AND VARIANT EMBODIMENTS

Figure 2:
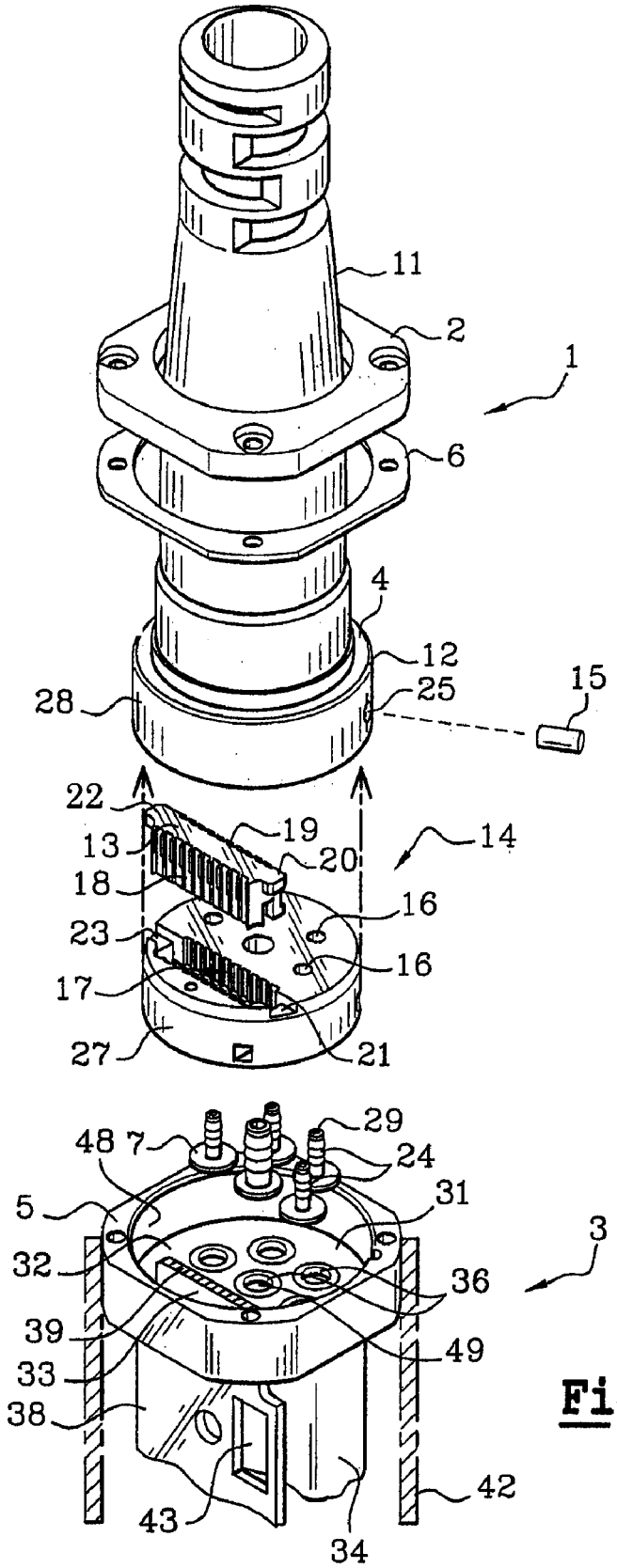
FIG. 2 is an exploded perspective view showing the terminal connection part of an umbilical and the connection part of a printer print head.

FIG. 2 shows an exploded perspective view of a terminal connection part 1 of an umbilical and the connection part 3 of a printer print head.

The electrical and hydraulic terminal parts of the umbilical are known in themselves and are not shown, so that attention can be concentrated on the invention itself.

The terminal part 1 of the umbilical comprises an enclosure 11 housing the terminal parts of the electrical conductors and hydraulic pipes, in a manner known in itself.

In accordance with the invention, a hollow rigid terminal part 12 referred to as the bell 12 of the enclosure 11 in the following description contains means 13 and 14 for positioning the electrical terminal parts, and means 14 for positioning the hydraulic terminal parts. This bell includes a hollow part that cannot be seen in FIG. 2, provided with a flat bottom 4, the centre of which is drilled to allow hydraulic pipes and electrical conductors contained in the umbilical to pass through it. On the outside, one of the lateral peripheral surfaces 28 of the bell 12 is parallel to a local axis of the umbilical. In the example shown, the positioning means 14 of the hydraulic terminal parts consist of a roller 14 made from a non-conducting material, for example plastic. This roller 14 comprises through holes 16 cooperating with ribbed fittings 24, more frequently called annular fittings, to house and position the hydraulic terminations formed by these fittings 24. The ribbed fittings 24 are themselves composed of an axial part 29 notched on the outside and terminated by a drilled flat washer 7 forming a single part with the axial part 29. The washer 7 is thus mechanically connected in a leak tight manner to the axial part 29 of the fitting 24. The roller 14 is provided with a cavity 17.

In the example shown, the positioning means 13 and 14 of the electrical terminal parts are composed of a connector 13 itself formed by an insulating part 18 on which conducting strips 19 are fixed. The geometric shape of the cavity 17 of the roller 14 is such that the fitting 13 will fit into it and be positioned with respect to the roller 14. The insulating part 18 of the fitting 13 has positioning parts 20, 22 that cooperate with parts 21, 23 respectively positioning the roller 14, such that the position of the conducting strips 19 with respect to the roller 14 is perfectly determined. In the example shown, the positioning parts 20–23 are composed of projecting parts 20, 22 of the fitting 13 and hollow parts 21, 23 of the roller 14.

The connection part of the umbilical is assembled as follows. The hydraulic terminations of the umbilical each pass through a through hole 16. They are then tightened on axial parts 29 of the ribbed fittings 24. Each ribbed fitting 24 is then forced each into a through hole 16.

Figure 1:
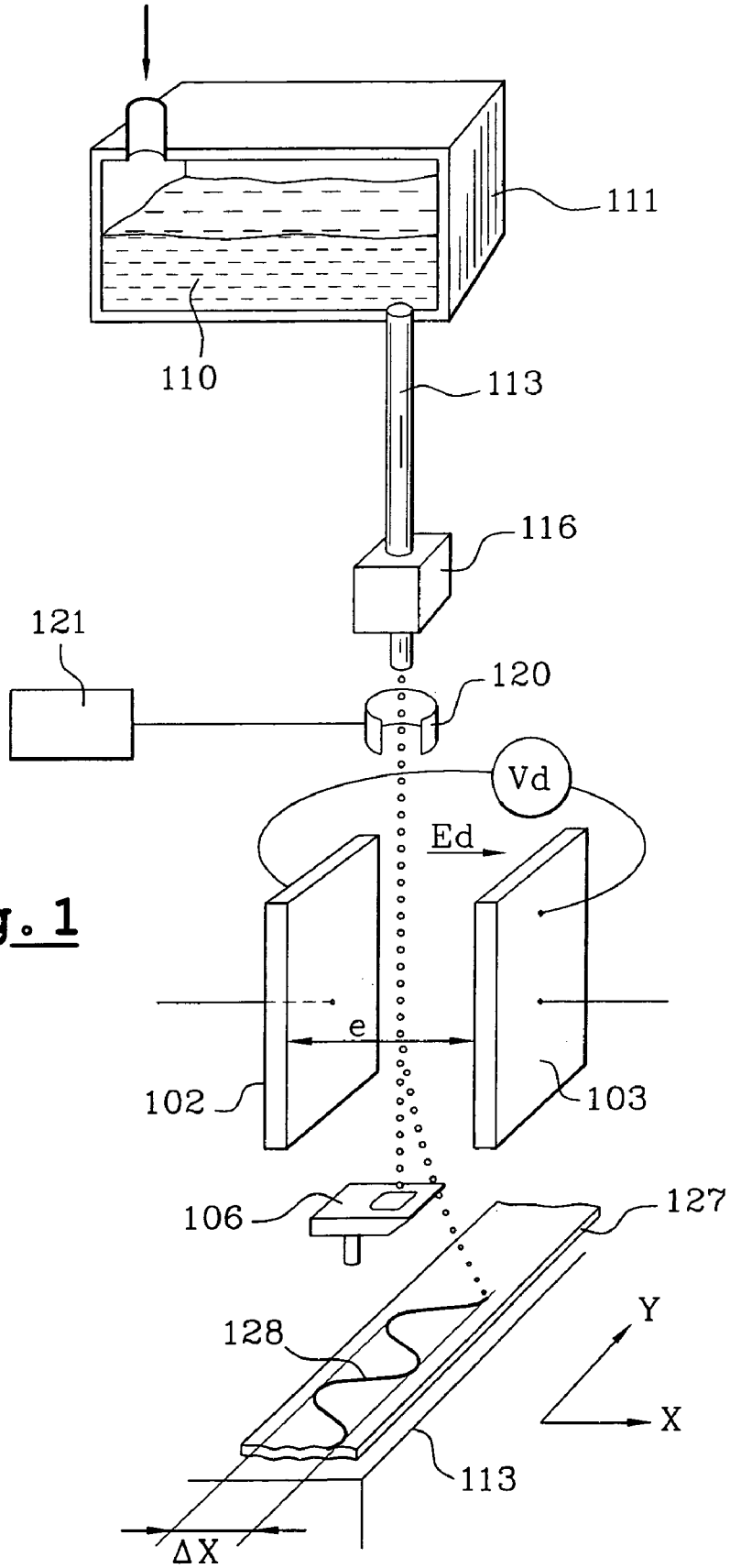
FIG. 1, already described, shows the main components of a continuous deviated ink-jet printer.

The electrical terminal parts of the umbilical are fixed on strips 19 of the fitting 13. The fitting 13 is housed and positioned in the cavity 17, the projecting parts of the fitting 13 or the roller 14 fitting into the hollow parts of the roller 14 or the fitting 13 respectively. The roller 14 is then forced into the bell 12 until it stops in contact with the inner part of the bottom 4 of the bell 12, not visible in FIG. 2. Preferably, the roller is tightened in the bell 12. In this position, the fitting 13 also stops in contact with the inner part of the bottom 4 of the bell 12, which puts it in an axial position. The angular position of the roller and therefore of the fitting 13 with respect to a central axis of the umbilical at the bell 12 may be controlled by any means. It may be corresponding external shapes, for example oval shapes of the bell 12 and the roller 14, such that the roller can only be in one angular position before it is inserted into the bell, or pins and positioning holes on the bell or the roller. In the example shown in FIG. 1, a pin 15 fits into a through hole 25 of the bell, the axis of which is perpendicular to the local axis of the umbilical and in a blind hole (not shown) of the roller 14 and hollowed out from an outer peripheral surface 27 of the said roller. In the assembled position, the plane surface of the roller 14 opposite the plane surface of this roller in contact with the bottom 4 of the bell 12 is flush with the edge of the side surface 28 of the bell 12, projecting very slightly beyond this bell. This means that the thickness of the roller 14 is very slightly greater, than the height of the inner edge of the bell 12 formed by the inner surface corresponding to the outer edge 28.

In the example that has just been described, the first positioning means for positioning the electrical terminations in the umbilical are composed of the bell 12, for which the bottom 4 forms a stop positioning the connector 13 in the local axial direction of the umbilical, the roller 14, its cavity 17 and positioning means 20–23 of the connector 13 with respect to the roller 14, the pin 15, the through hole 25 of the bell 12, and a blind hole of the roller 14. The second positioning means of the hydraulic terminations in the connection part of the umbilical are composed of the bell 12, for which the bottom 4 forms a stop positioning the roller 14 in the local axial direction of the umbilical, the roller 14 with its holes 16 housing and positioning the hydraulic connections 24, the pin 15, the through hole 25 of the bell 12 and a blind hole of the roller 14. The fact that the roller 14 positions the connector 13 and the hydraulic terminations, enables a particularly simple and compact form of the first and second means of positioning the electrical and hydraulic connections. Finally, it can be seen that the first and second positioning means are mechanically fixed to the umbilical such that all that is necessary during assembly or disassembly of the print head, is to move the umbilical by an axial translation movement to disconnect or connect the umbilical.

The connection part 3 of the print head will now be described.

Essentially, it comprises a base composed of a plane surface 31 and means of positioning and holding the umbilical. A casing (or enclosure) 42 has been shown transparent to show a body 34 of the print head and a printed circuit 38 that will be described in more detail later. In the example shown in FIG. 2, these positioning and holding means are composed of a peripheral surface 48 perpendicular to the plane surface of the fixed connector 31. In the example shown, the fixed connector 31 and the peripheral surface 48 delimit a hollow part 32. Hydraulic control terminations 36 of the connection part 3 of the print head open up onto the fixed connector 31.

The terminations 36 of the hydraulic pipes are arranged on the fixed connector 31 such that the hydraulic terminations 36 are along the extension of the axial parts 29 of the fittings 24 when the umbilical is connected to the connection part 3 of the print head. A printed circuit plate 38 has its plane perpendicular to the surface of the fixed connector 31. An end part 33 of this plate on which the electrical terminations 39 are fitted, opens up into the hollow part 32. The plate 38 is positioned such that the electrical terminations 39 are in electrical contact with the electrical terminations 19 of the connector 13 when the umbilical is connected to the connection part 3 of the print head.

Operation of the connection assembly is as follows.

The height of the outside surface 28 of the bell 12 is approximately the same as the height of the internal peripheral surface 48 of the hollow part 32. The outside shape of the surface 28 is such that it corresponds to the inside shape of the internal peripheral surface 48 of the hollow part 32. Consequently, the bell 12 may penetrate into the recess 32 in an adjusted manner, until the terminal washer 7 of the fittings 24 comes into contact with the bottom 31 of the hollow part 32. The axial parts 29 of the fittings 24 are then in line with the axes of the hydraulic pipes of the print head. Contacts 19 of the connector 13 come into contact with the electrical terminations 39 of the printed circuit 38. In the example shown in FIG. 1, the bell 12 and the inside surface 48 of the hollow part 32 are cylinders of revolution. In this case, all that is necessary for good angular position of the umbilical and the print head during assembly, is to provide a polarizing device in a manner known in itself. Seals 49, for example O-rings, placed in grooves (not shown) on the surface 31 can make the fittings leak tight. These grooves form means of positioning the seals 49. Means of fastening the umbilical onto the print head are used to fix the umbilical and to clamp the seals.

In the example described above, the external part 28 fits into the hollow part 32 of the print head. Naturally, it is possible to organize things such that the hollow part of the bell 12 is sufficiently deep so that this bell 12 still holds an empty hollow part when the roller 14 is housed inside it. This hollow empty part may then contain a part that will project from the print head, the summit of this projecting part being the fixed connector 31. In this embodiment (not shown) the connection part 3 of the print head is connected to the umbilical by penetration into the empty part of the bell 12, until the fixed connector 31 stops in contact with the surface of the roller 14 opposite the part that stops on the bottom 4 of the bell 12.

In the example shown in FIG. 2, the attachment and clamping means of the terminal connection part 1 of the umbilical to the connection part 3 of the print head comprise a flange 2 bearing on a shoulder formed by the external part of the bottom 4 of the bell 12. The flange 2 is screwed by screws (not shown) onto a collar 5 surrounding the hollow part 32. A leak tight seal 6 is preferably inserted between the flange 2 and the collar 5 to keep the internal part of the umbilical connection dust free. Since the roller 14 is flush and projects slightly outside the bell 12, clamping the flange 2 on the collar 5 efficiently clamps the hydraulic seals 49.

One of the functions of the printed circuit 33 will now be described in more detail. The simplicity and the relatively small size of the electrical connector 13 and the electrical terminals 39 of the printed circuit 33 are due to the fact that in the preferred embodiment of the invention, there is no high voltage connection between the terminal connection part 1 of the umbilical and the connection part 3 of the print head. This is due to the fact that in the preferred embodiment of the invention, the high voltage equal to several thousand volts required particularly by the ink drop deflection electrodes, is made inside the casing 42 of the print head. To achieve this, the printed circuit 33 comprises surface mounted elements that cooperate and together form a high voltage source starting from a low voltage source received through one of the contacts 39, in a manner known in itself. These circuits are known in themselves and are represented by a rectangle 43 on the printed circuit 33.

According to one variant of the general or preferred embodiment of this invention, the deflection electrodes have a particular shape. This particular shape, as explained above, can give good deflection performances with a significantly lower voltage than normal voltages used for the power supply of equipotential deflection electrodes.

Figure 3:
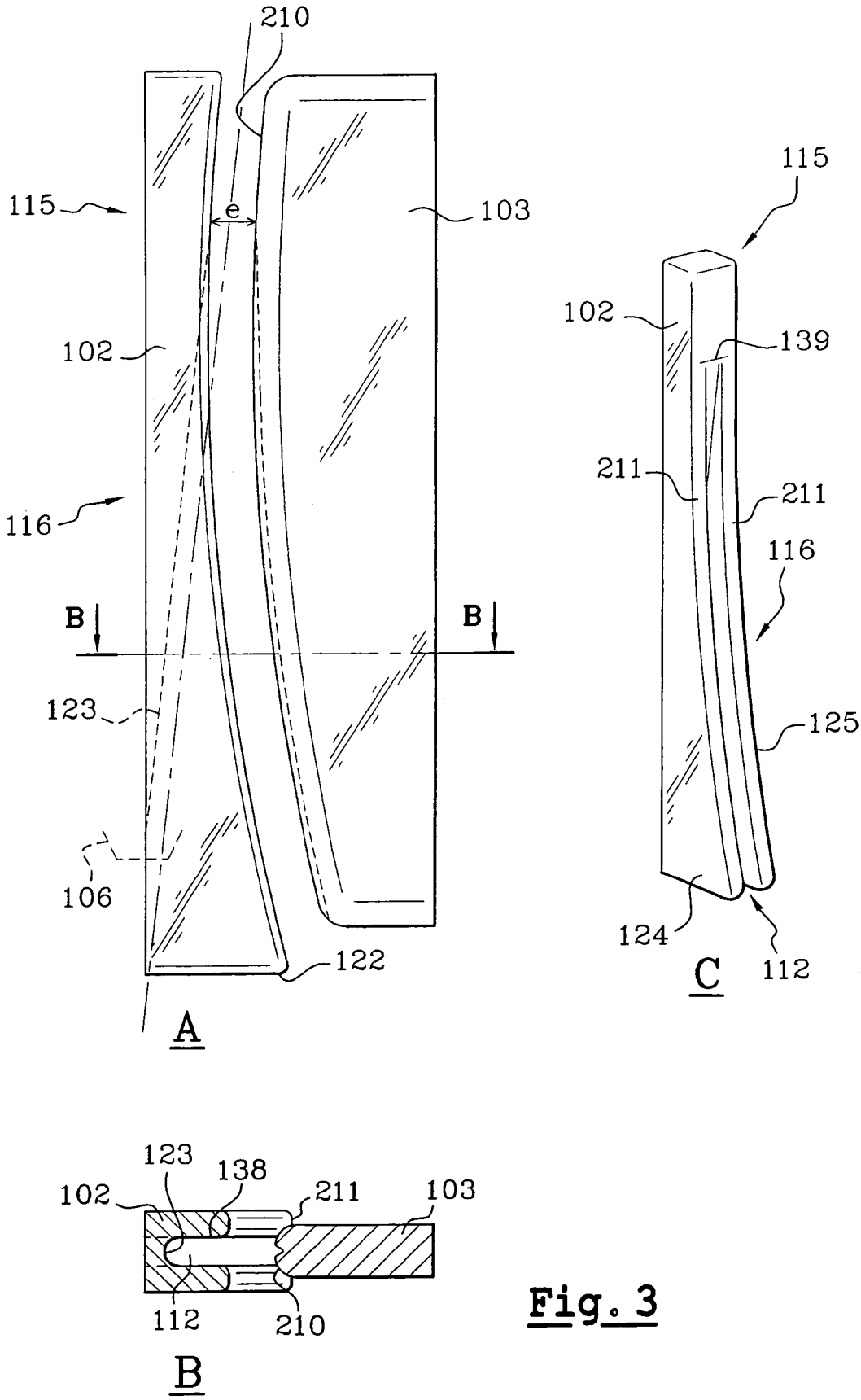
FIG. 3 includes parts A, B and C.

This particular embodiment will now be described with reference to FIG. 3, in which there are parts A, B and C.

The deflection electrodes 102, 103 each have an upstream part 115, and a downstream part 116, considering the direction of flow of an ink jet from the printer, in which only the axis is shown by a centreline. A so-called active surface 211, 210 of each deflection electrode 102, 103 is a surface of the said electrode 102 or 103 that is facing the other electrode. The axis of the ink jet passes through the upstream part of the said first electrode 102 and second electrode 103 between the two active surfaces 211, 210 of these first 102 and second 103 electrodes. The active surface 211 of the first electrode 102 has a first concave longitudinal curvature for which the local radius of longitudinal curvature is located in a plane formed by the axis of the ink jet and a drop deviation direction. The active surface 210 of the second electrode 103 has a first convex longitudinal curvature. The first electrode has a slit 112 in its downstream part 116, in which the furthest upstream point 139 is located close to the intersection of the active surface 211 of the first electrode 102 with the axis of the ink jet.

The two electrodes 102, 103 have approximately equal heights. A plane tangent to the active surfaces 211, 210 of the electrodes 102 and 103 respectively, in their upstream part is parallel to the axis of a jet or secant to this axis at a small angle.

The concave longitudinal curvature of the active surface 211 of the first electrode 102 is approximately opposite the convex longitudinal curvature of the active surface 210 of the second electrode 103 such that the distance between the active surfaces 211 and 210 of the first and second electrodes is approximately constant. The active surface 210 of the electrode 103 has a convex longitudinal curvature such that this surface is in a downstream part, approximately parallel to a path (not shown) of the most highly deviated drops. A path may be displayed by stroboscopic lighting of the drops, in a known manner.

Since the space e separating the active surfaces 210 and 211 is approximately constant over the entire height of the electrodes 102, 103, the electrostatic deviation field between these electrodes is also approximately constant throughout the inter electrode space. The value of the spacing e is less than 3.5 mm, and is preferably less than 2 mm. In order to avoid hindering the paths of the drops with the lowest charges, a recess 112, which in the example shown is in the form of a slit 112, visible in parts B and C in FIG. 3, is formed in a downstream side of the electrode 102. The width of the recess 112 is greater than the diameter of the ink drops. In practice, the width of the recess 112 is advantageously limited such that the drop of the value of the existing field Ed in the downstream part of the electrodes 102, 103 does not exceed 15% of the drop of the value of the optimum field created in its upstream part. In the example shown in FIG. 3, the slit 112 is in the form of a groove formed starting from the active surface 211 of the first electrode 102. The depth of this groove increases as the distance towards the downstream side of the electrode 102 increases, as materialized by a dashed line 123 representing the bottom of the said groove 112. This bottom is approximately parallel to the centreline of the jet axis materialized by the centreline. The axis of the jet is approximately parallel to the bottom 123 of the groove 112. In a downstream part of the electrode 102, the depth of the groove 112 becomes greater than the local width of the electrode such that the edges of the groove 112 form two tabs 124, 125 between which there is a gutter 106.

When the electrode is in the form of a metallic sheet, the slit immediately becomes a through slit. The gutter 106 is placed on the upstream side of the part 122 furthest downstream from the electrode 102. An opening of the gutter 106 intersects the ink jet axis.

The longitudinal curvature of the electrodes is preferably constant, such that the active surfaces 211, 210 of the electrodes 102, 103 are formed approximately by parts of a cylindrical surface with an axis perpendicular to the axis of the jet.

The electrodes 102 and 103 are preferably made from a non-oxidizing metal.

Operation is as follows.

The electrical field Ed resulting from the potential difference Vd between the two electrodes 102, 103 deviates the ink drops proportionally to their electrical charge along predefined paths. The path followed by drops carrying a maximum charge Qmax is close to and approximately parallel to the active surface 210 of the second electrode 103, in the downstream part of the active surface. This is the path of the most highly deviated drops. The active surface of the second electrode 103 is calculated such that the probability of meeting the path of the most highly deviated drops with the second electrode 103 is practically zero, although this path is parallel and close to the active surface 210 of the second electrode 103, at least in the downstream part of this surface. However, the path followed by drops with the minimum charge Qmin necessary to avoid the recovery gutter 106, and therefore directed towards the print substrate, is closer to the bottom 123 of the slit 112. The drops with electrical charges between the values Qmax and Qmin follow the intermediate paths. Drops with no electrical charges or with only small charges, in other words with a charge less than Qmin, follow an almost straight path coinciding with the axis of the jet and are therefore intercepted by the opening of the recovery gutter 106. These drops recovered by the gutter 106 are recycled in a known manner.

As explained above, the slit 112 is such that the least deviated drops, and particularly drops for which the charge is less than Qmin, pass through the slit 112. The result is that the upstream part 139 of a contour 138 around this slit 112 is located at a location close to the intersection point of the axis of the jet with the first electrode 102. Since drops for which the charge is less than Qmin and drops with the smallest charges among the drops with a charge of between Qmin and Qmax, pass through the slit 112 of the electrode 102, dispersion of the drops may be conserved despite the fact that the space e between electrodes 102 and 103 is smaller than between electrodes according to prior art.

The small dimension of the space e enables the use of an inter-electrode voltage value Vd of the order of 3 kV instead of 8 to 10 kV usually used in devices with conventional deflection electrodes. It is then particularly advantageous to make the potential difference Vd by bringing the electrode 102 up to the ink reference potential, usually the printer ground potential. Under these conditions, unlike prior art in which the potential is opposed to the potential of electrode 103 with respect to the ink potential, it becomes possible to bring the recovery gutter 106 and the electrode 102 closer together, or even to combine them as shown in FIG. 3 part A, without any risk of an electrical breakdown between these two elements and without modifying the field Ed between the two electrodes. The result is that this reduces the size of the print head, and the path followed by drops directed towards the gutter 106 is shortened, and therefore the probability that these drops will not reach this gutter is reduced. Since the gutter is located on the upstream side of the point 122 furthest downstream from the deviation electrodes, the print substrate can be brought closer to the deviation electrodes. This thus shortens the path of drops sent towards the print substrate and the result is an improvement in the print quality.

The invention claimed is:

1. An ink jet printer comprising a print head with a connection part (3) of the print head to connect the electrical and hydraulic terminal parts of the print head to an umbilical connected to the printer hydraulic circuits and to electrical conductors, the umbilical being provided with a terminal connection part (1) formed by hydraulic pipe terminations and electrical conductor terminations, characterised in that the connection part (1) of the umbilical comprises first positioning means (12, 13, 14, 15, 17, 18, 20–23, 25) mechanically connected to the connection part (1) of the umbilical to position the electrical terminations in the connection part (1) of the umbilical;

second positioning means (12, 14, 15, 16, 25) mechanically connected to the connection part (1) of the umbilical to position the hydraulic terminations in the connection part (1) of the umbilical;

third positioning means (12, 28) mechanically connected to the umbilical, and in that the connection part (3) of the print head is provided with:

a fixed connector (31) of a body (34) of the print head, this fixed connector (31) comprising hydraulic pipe terminations (36) from a body of the print head for which one opening (36) is at a determined position on the fixed connector (31), and electrical conductor terminations (39) positioned mechanically with respect to the fixed connector (31);

fourth positioning means (31, 48) mechanically connected to the connection part (3) of the print head;

and in that in a position in which the umbilical and the print head are connected, the third (12, 28) and fourth connection means (31, 48) cooperate to position the connection part (1) of the umbilical with respect to the connection part (3) of the print head, electrical terminations (19) of the umbilical positioned in the connection part (1) of the umbilical by the first positioning means (12, 13, 14, 15, 17, 18, 20–23, 25) being in the said connected position of the umbilical and the print head in contact with terminations (39) of electrical conductors mechanically positioned with respect to the fixed connector (31), and hydraulic terminations (24) of the umbilical positioned by the second positioning means (12, 14, 15, 16, 25) of the umbilical being located in line with the hydraulic terminations (36) of the fixed connector, a leak tight communication being set up between the hydraulic terminations (24) of the umbilical and the hydraulic terminations of the pipes from the print head body (34) thus formed.

2. The ink jet printer according to claim 1, characterized in that hydraulic terminal parts (36) of the connection part of the print head comprise hydraulic pipe openings (36) opening up onto the fixed connector (31), these openings being provided with means for positioning the seal.

3. The ink jet printer according to claim 2, characterized in that hydraulic terminations (24) of the connection part (1) of the umbilical comprise a washer (7) connected to an axial part (29) of the hydraulic termination (24) in a leak tight manner, and this washer compresses a seal (49) positioned by the positioning means of the seal when the connection part (1) of the umbilical is connected to the connection part (3) of the print head.

4. The ink jet printer according to any one of claims 1 to 3, characterized in that the first means for positioning the electrical terminations of the connection part (1) of the umbilical are composed of an electrical connector (13), a roller (14) provided with a cavity (17), a bell (12) mechanically fixed to the connection part (1) of the umbilical, the cavity (17) housing and positioning the connector (13) with respect to the roller (14), the roller (14) housing the connector (13) being itself housed and positioned in the bell (12) by means (15, 25) for positioning the roller with respect to the bell (12).

5. The ink jet printer according to claims 1 to 3, characterised in that the second positioning means of the hydraulic terminal parts (24) of the connection part (1) of the umbilical consist of a roller (14) comprising through holes (16), a bell (12) mechanically fixed to the connection part (1) of the umbilical, the through holes (16) housing and positioning the hydraulic terminations (24) with respect to the roller (14), the roller (14) housing the hydraulic terminations (24) of the connection part (1) of the umbilical, itself housed and positioned in the bell (12) using means (15, 25) of positioning the roller with respect to the bell (12).

6. The ink jet printer according to claim 4, characterised in that, apart from the cavity (17) that houses and positions the fitting (13) with respect to the roller (14), the roller (14) also comprises through holes (16), the through holes (16) housing and positioning the hydraulic terminations (24) with respect to the roller (14).

7. The ink jet printer according to one of claims 1 to 3, characterised in that the third means for positioning the connection part (1) of the umbilical with respect to the connection part (3) of the print head comprise an external part (28) of a bell (12) mechanically fixed to the connection part (1) of the umbilical, the external part (28) of the said bell (12) having a shape corresponding to an inner shape (48) of a hollow part (32) of the connection part (3) of the print head, one of the delimitation surfaces of this hollow part (32) of the connection part (3) of the print head being formed by the fixed connector (31).

8. The ink jet printer according to one of claims 1 to 3, characterized in that the third means for positioning the connection part (1) of the umbilical with respect to the connection part (3) of the print head are composed of an inner part of a bell (12) mechanically fixed to the umbilical connection part (1), the inner part of the said bell (12) having a shape corresponding to an external shape of a projecting part of the connection part (3) of the print head, one of the delimitation surfaces of this projecting part of the connection part (3) of the print head being formed by the fixed connector (31).

9. The ink jet printer according to claim 4, characterized in that the third means for positioning the connection part (1) of the umbilical with respect to the connection part (3) of the print head are composed of an inner and an outer part of the said bell (12), the outer part (28) or inner part of the said bell (12) having a shape corresponding to an inner shape (48) of a hollow part or an outer shape of a projecting part of the connection part (3) of the print head, one of the delimitation surfaces of this hollow or projecting part (32) of the connection part (3) of the print head being formed by the fixed connector (31).

10. The ink jet printer according to one of claims 1 to 3, characterized in that the print head of the said printer is provided with a casing (42) particularly housing a production circuit (43) of a high electrical voltage.

11. The ink jet printer according to one of claims 1 to 3, characterized in that the print head of the said printer is provided with at least two deflection electrodes, a first electrode (102) and a second electrode (103), the deflection electrodes (102, 103) each having an upstream part (115), and a downstream part (116), considering the direction of flow of an inkjet from the printer, an active surface (211, 210) of each deflection electrode (102, 103) being a surface of the said electrode (102, 103) that is facing the other electrode, the active surface (211) of the first electrode (102) having a first concave longitudinal curvature for which the local radius of longitudinal curvature is located in a plane formed by the axis of the ink jet and a drop deviation direction, and in that the active surface (210) of the second electrode (103) has a first convex longitudinal curvature, and in that the first electrode has a slit (112) in its downstream part (116), in which a furthest upstream point (139) is located close to the intersection of the active surface (211) of the first electrode with the axis of the ink jet.

12. The ink jet printer according to claim 11, characterised in that the distance between the active surfaces (211, 210) of the first and second electrodes (102, 103) is approximately constant from the upstream side to the downstream side of the electrodes.

13. The print head of the ink jet printer according to one of claims 1 to 3 having a connection part (3) of the print head to connect electrical and hydraulic terminal parts of the print head to an umbilical connected to the printer hydraulic circuits and electrical conductors, characterised in that the connection part (3) of the print head is provided with:

a fixed connector (31) of a body (34) of the print head, this fixed connector (31) being formed by hydraulic pipe terminations (36) from a body of the print head for which one opening (36) is at a determined position on the fixed connector (31), and electrical conductor terminations (39) positioned mechanically with respect to the fixed connector (31)

fourth positioning means (31, 48) mechanically connected to the said connection part (3) of the print head, these fourth positioning means (31, 48) being designed to cooperate with third means (12, 28) for positioning the umbilical, the cooperation of the third positioning means (12, 28) and fourth positioning means (31, 48) simultaneously positioning the hydraulic pipe terminations (36) and the electrical conductor terminations (39) of the print head fixed connector with respect to electrical conductor terminations (19) and hydraulic pipe terminations (24) located on the connection umbilical.

14. The print head of the ink jet printer according to claim 13, characterised in that the fourth positioning means of the print head comprise a part (48) of an inner surface of a hollow part (32) or an outer surface or a projecting part of the connection part (3) of the print head, one of the delimitation surfaces of this hollow part (32) or projecting part of the connection part of the print head being formed by the fixed connector (31).

15. The print head of the ink jet printer according to claim 13, characterised in that the hydraulic terminations (36) of the connection part (3) of the print head comprise hydraulic pipe openings (36) opening up onto the fixed connector (31), these openings being provided with means for positioning the seal.

16. The print head of the ink jet printer according to claim 13, characterised in that the print head of the said printer is provided with a casing (42) particularly housing a production circuit (43) of a high electrical voltage.

17. The print head of the ink jet printer according to claim 13, characterised in that it is provided with at least two deflection electrodes, a first electrode (102) and a second electrode (103), the deflection electrodes (102, 103) each having an upstream part (115), and a downstream part (116), considering the direction of flow of an ink jet from the printer, an active surface (211, 210) of each deflection electrode (102, 103) being a surface of the said electrode (102, 103) that is facing the other electrode, the active surface (211) of the first electrode (102) having a first concave longitudinal curvature for which the local radius of longitudinal curvature is located in a plane formed by the axis of the ink jet and a drop deviation direction, and in that the active surface (210) of the second electrode (103) has a first convex longitudinal curvature, and in that the first electrode has a slit (112) in its downstream part (116), in which a furthest upstream point (139) is located close to the intersection of the active surface (211) of the first electrode with the axis of the ink jet.

18. The print head of the ink jet printer according to claim 17, characterised in that the distance between the active surfaces (211, 210) of the first and second electrodes (102, 103) is approximately constant from the upstream side to the downstream side of the electrodes.

* * * * *